United States Patent [19]

Grabovac

[11] 3,979,979

[45] Sept. 14, 1976

[54] DRIVE SOCKET

[75] Inventor: Bosko Grabovac, Mission Viejo, Calif.

[73] Assignee: Consolidated Devices, Inc., City of Industry, Calif.

[22] Filed: Nov. 7, 1975

[21] Appl. No.: 629,804

[52] U.S. Cl. ..... 81/121 R; 76/114

[51] Int. Cl.[2] ..... B25B 13/06; B21K 5/16

[58] Field of Search ..... 8/119, 121 R, 121 A; 76/114, DIG. 6

[56] References Cited

UNITED STATES PATENTS

| | | | |
|---|---|---|---|
| 1,546,418 | 7/1925 | Stresau | 76/114 |
| 1,826,765 | 10/1931 | Gang | 76/114 |
| 3,709,073 | 1/1973 | Kurtz | 76/114 X |
| 3,868,874 | 3/1975 | Olashaw | 81/121 R |

*Primary Examiner*—Al Lawrence Smith
*Assistant Examiner*—James G. Smith
*Attorney, Agent, or Firm*—Georges A. Maxwell

[57] ABSTRACT

A drive socket with front and rear end portions defining front and rear ends, an elongate, forwardly opening polygonal work receiving socket and an elongate, rearwardly opening polygonal drive tool receiving opening, said drive socket defined by a multiplicity of flat radially extending sheet metal laminates in intimate juxtaposition and having registering openings in radial and circumferential spaced relationship about the axis of the drive socket, elongate tie members engaged through the registering openings with ends in stopped engagement with the front and rear ends of the drive socket, the laminates having central openings corresonding in configuration with the cross-section of the work receiving socket and drive tool receiving opening in their related portions of the drive socket.

9 Claims, 14 Drawing Figures

DRIVE SOCKET

This invention has to do with a drive socket and is particularly concerned with an improved socket structure for the transmission of torsional forces between axially aligned parts with polygonal tool engaging portions.

In the hand tool art, a number of special, though extremely common and familiar, tool or tool parts are provided to apply torsional forces onto nuts, bolts, screws and other similar rotatable fastener and machine elements which are provided with polygonal tool engaging portions or heads, accessible at ends thereof. One of the most common of such tools is a drive socket. The ordinary, conventional drive socket is a unitary part and consists of an elongate cylindrical body with a central, axially extending polygonal driver receiving opening in one end portion and a central axially extending polygonal work receiving socket in its other end portion. The driver receiving openings in such sockets are generally square openings and are adapted to slidably receive and establish rotary driving engagement with a square end portion or drive pin of a related manually engageable drive tool such as a crank-type or a racket-type wrench lever arm. The driver receiving opening, while most commonly square, can be and oftentimes are hexagonal or splined openings.

For the purpose of this disclosure, I will illustrate and will describe my new drive socket structure as having a square driver receiving opening and a six-sided or hexagonal work receiving or engaging socket. It is to be understood, however, that in practice, the shape or configuration of the noted openings and sockets can be varied or changed to correspond with any of the several other configurations that are employed by the art, or can be readily established in some special or unique configuration that might be required.

In the tool art with which my invention relates, the availability, serviceability and cost of small size drive sockets with work receiving sockets less than 1½ inches, is excellent. However, in the case of large size drive sockets with work receiving sockets greater than 1½ inches, availability and serviceability is poor and costs are excessive.

Due to the fact that large drive sockets such as referred to above are needed and used less often than the smaller size drive sockets, the manufacturers of such tools oftentimes do not maintain inventories of such drive sockets and instead produce them on a very limited basis or on special order only. As a result, delivery of a large size drive socket is more than 2 months from the date of order or puchase.

Large size drive sockets are established of high grade steel and are machined from large diameter round bar stock. During milling of the bar stock from which such drive sockets are machined, a well defined grain extending longitudinally of the axis of the stock is established, which grain extends longitudinally of the axis of the drive sockets machined from the stock. In light of this direction of growth and upon considering the distribution of forces exerted into and through one drive socket when in use, it will be seen and become readily apparent that the forces transmitted through the metal or stock of the drive sockets are substantially normal to the axis of the grain, subjecting the grain to shearing forces. It is well known that metals having directional grain are notably weakest with respect to and have a great tendency to yield and to break under the effects of shearing forces, that is, forces directed therethrough which are substantially normal to the axis of the grain.

It is to be noted that in large size, machined sockets, they could be machined from milled stock so that the grain is normal, rather than parallel with the axis of the sockets, but in order to gain such an end materially, larger pieces of raw stock would have to be employed and a materially greater amount of machining to remove excess stock would be required, with the result that the resulting drive sockets would be materially more costly to manufacture than are those extremely costly sockets made in accordance with common practice, where the grain of the stock is parallel with the axis of the sockets.

As a result of the above noted and considered grain of common or conventional machined sockets, such sockets can be said to be weakened by the grain of the metal.

In some instances, sockets are established from forged slug-like blanks. In forging such blanks, the metal is moved longitudinally relative to the axes of the blank and a longitudinal extending grain is established therein, which, as in the case of machined sockets, extends parallel with the axes of the finished sockets and weakens the sockets.

In the case of machined or forged drive sockets, such as referred to above, when the stock of the sockets if fractured or weakened by externally applied work forces, such as by a blow, impact or abrasion and shearing forces such as are noted above are applied through the sockets, which forces are sufficient to cause separation at the fractured or weakened points or areas, there is a tendency for the fracture or point of separation to readily extend and progress longitudinally of the grain of the socket stock with resulting distinction of the structures or with resulting damage which renders the structures less than wholly serviceable.

In the normal use of drive sockets, they are commonly subjected to sharply applied impact force to effect tightening and/or loosening of the work by torquing. Due to the unitary or integrated stock of such sockets, such impacting torsional forces subject the stock to extremely high shearing forces under which the stock must yield (as is afforded by the modulus of elasticity of the stock) or fail. Upon repeated application of impacted forces, as noted above, the stock of common drive sockets work hardens rather rapidly with resulting premature failing of the metal and far shortening of the expected work life of the sockets.

It is to be noted that in the case of common drive sockets, once a socket is cracked, chipped or some critical portion thereof is worn, the socket is spent, its work life is ended and what is left, from all practical aspects, is waste.

An object and feature of my invention is to provide a novel drive socket of the general character referred to above, the basic outside and inside configuration of which is essentially or substantially the same as conventional drive sockets of like size and which is compatible with equivalent work and conventional relatable support tools and equipment for drive sockets.

It is an object and feature of my invention to provide an elongate drive socket structure of the character referred to above comprising a multiplicity of radially extending longitudinally stacked steel laminates in the nature of apertured discs stamped from flat milled sheet stock.

An object of my invention is to provide a drive socket structure of the character referred to above wherein the longitudinal grain of the sheet stock from which the laminates or discs are formed or stamped extend normal to the longitudinal axes of the drive socket so that torsional forces transmitted through the structure in novel use thereof subject the grain of the metal stock to compressive forces, rather than the shearing forces as in the case of conventional drive sockets.

Still another object and feature of my invention is to provide a structure of the general character referred to above wherein the disc-shaped laminates are rotatably arranged one with respect to the other so that the axis of the grain of certain laminates is on an axis normal to or angularly related to the axis of the grain of other laminates.

Yet another object and feature of my invention is to provide a drive socket structure of the general character having circumferentially spaced longitudinally extending tie members either releasably or permanently securing the laminates in stacked aligned relationship.

It is another object and feature of the invention to provide novel force transmitting means between adjacent laminates and to provide work receiving sockets and/or tool receiving openings having novel stress rise releasing means.

An object of this invention is to provide a drive socket structure of the character referred to wherein the tie members and/or force transmitting means affords shock absorbing yielding torsional deflection of the structure throughout its longitudinal extent, whereby the structure will withstand greater impact forces than drive sockets of equal size provided by the prior art.

It is another object of the invention to provide a structure of the character referred to which is such that the structure will yield and conform to irregularities on matting surfaces of related tools and work before it will become irreparably damaged, break or be rendered inoperable by such irregularities.

A highly important object and feature of my invention is to provide a structure of the character referred to which is made up of easy and economical to make laminates that can be easily, quickly and economically manufactured, whereby drive sockets embodying the invention can be manufactured more quickly and at materially less cost than conventional drive sockets of comparable size.

It is an important object and feature of my invention to provide a drive socket structure of the general character referred to above which is such that it can be easily, conveniently and economically repaired by simply disassembling the laminates, repairing and/or replacing worn or damaged laminates and re-assembling the structure, thereby avoiding the waste, great cost and inconvenience associated with the replacement of conventional drive sockets when they become worn or damaged.

An object and feature of my invention is to provide a drive socket structure which is such that it can be easily and economically made in any desired longitudinal extent (in excess of minimum requirements) to meet special requirements and/or to vary its torsional flexibility and ability to receive impact forces or yield to applied torsional forces.

Finally, it is an object and feature of my invention to provide a structure of the character referred to which lends itself to the establishment of light weight drive sockets with increased durability and strength, which end is effected by establishing laminates of high strength, tempered steel and of light weight durable alluminum alloy and establishing drive sockets of both steel and alluminum laminates in alternate series relationship throughout the longitudinal extent of the sockets.

The foregoing and other objects and features of my invention will be fully understood and will be apparent from the following detailed description of typical preferred forms and applications of my invention throughout which description reference is made to the accompanying drawings, in which.

Figure 1:
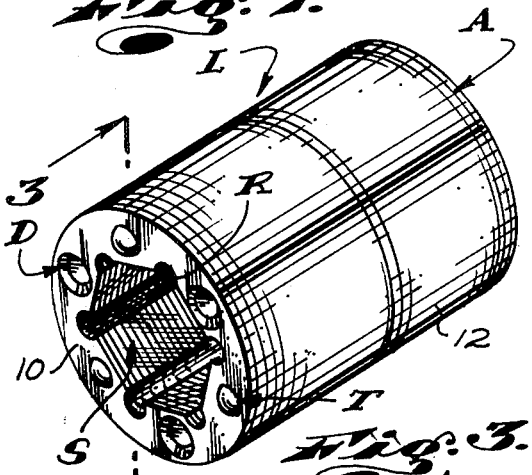
FIG. 1 is an isometric view showing the end and one side of a drive socket embodying my invention.
Figure 2:
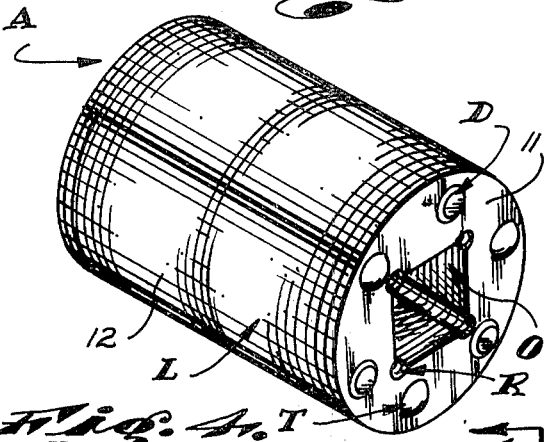
FIG. 2 is an isometric view showing the rear end and other side of the socket.
Figure 3:
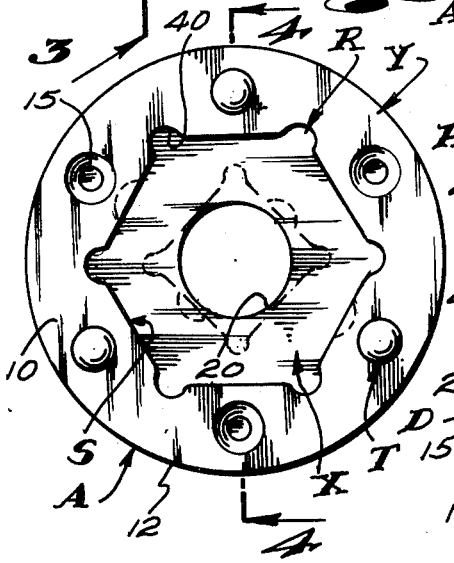
FIG. 3 is an enlarged front end view taken substantially as indicated by line 3—3 on FIG. 1.

Referring to FIGS. 1 and 2 of the drawings, the drive socket A that I provide is an elongate, unitary laminated structure made up of a plurality of longitudinally spaced, adjacent laminates L and is characterized by flat front and rear ends 10 and 11, a cylindrical side 12, an elongate, central work-receiving socket S entering the front end 10, an elongate, central drive tool receiving opening O entering the rear end 11, tie means T securing the laminates L together and drive means D establishing rotational driving engagement with or between adjacent laminates L.

The laminates L are round disc-like sheet metal parts stamped from milled sheet metal stock. The laminates L are preferably equal in diametric extent and are characterized by flat front and rear surfaces and a cylindrical outer edge.

Figure 4:
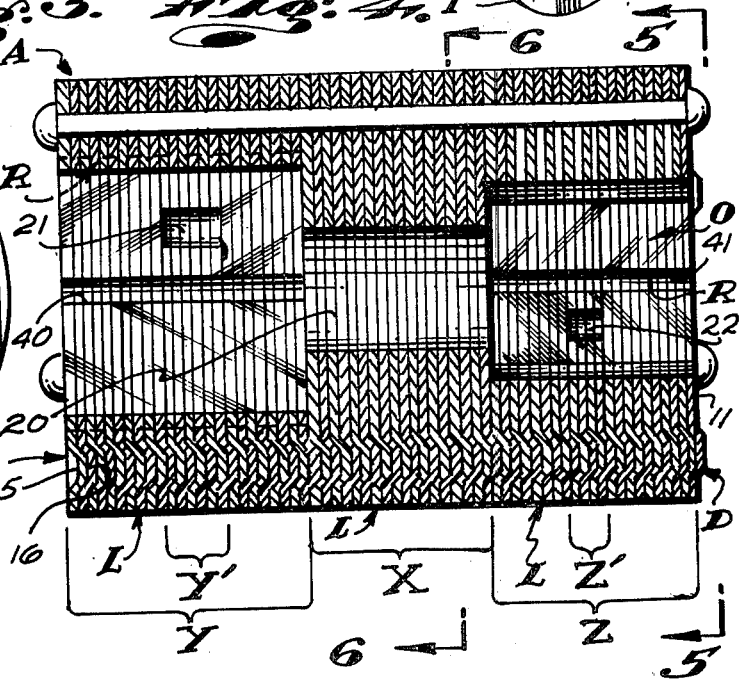
FIG. 4 is a longitudinal view taken substantially as indicated by line 4—4 on FIG. 3.
Figure 5:
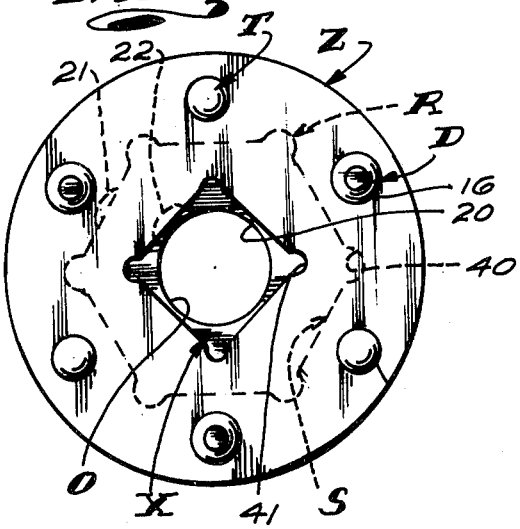
FIG. 5 is a rear end view taken as indicated by line 5—5 on FIG. 4.
Figure 6:
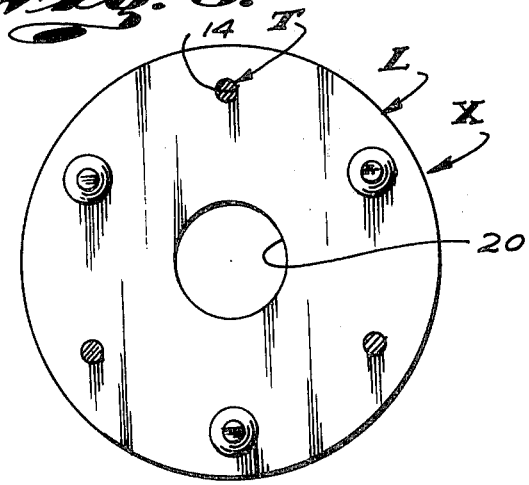
FIG. 6 is a cross-sectional view taken as indicated by line 6—6 on FIG. 4.

In establishing the structure, three basic forms of different laminates are provided. One form of laminate is provided to establish the portion of the structure in which the socket S occurs; another form is provided to establish the portion of the structure in which the opening O occurs and a third form can, when necessary or desired, be provided to establish the central portion of the structure occurring between the sockets and opening O. In FIG. 4 of the drawings, the portions of the structure established by the above noted different laminates are designated by the characters Y, X and Z and in FIGS. 7, 8 and 9 of the drawings and elsewhere in the drawings, where appropriate, the several different forms of laminates are identified by the same characters which designate the portion of the structure they serve to establish, that is, Y, X and Z.

Each of the laminates L (Y, X and Z) are characterized by a plurality (4) of circumferentially spaced tie member receiving openings or apertures 14 which register with each other in the finished assembly of laminates and in and through which the tie members T extend.

Additionally, each of the laminates L is provided with and is characterized by a plurality (4) of circumferentially spaced axially opening recesses 15 opening at and about one surface of the laminate and corresponding, opposite, axially projecting projections 16 at and about the other surface of the laminate. The several corresponding and opposite recesses and openings 15 and 16 are established by a single press forming operation performed at the same time the laminates are stamped from the sheet stock from which they are established.

The recesses and projections of adjacent laminates are registered with each other and establish nesting engagement with each other when the laminates are assembled and secured together by the tie means and establish the drive means D to prevent relative rotational movement between the laminates.

In the preferred carrying out of the invention, the preferred edges or perimeters of the recesses and projections are axially inclined (forwardly or rearwardly) in the same direction and such that upon the application of torsional forces in and through the structure which would result in relative rotary movement of the laminates, the projections 16 tend to ride out of or can move themselves out of engagement of their related recesses and resulting axial separation of the laminates. Such axial separation results or is resolved in the application of increased tension in the tie members T. The maximum extent of axial movement of the plates noted above is not sufficient to result in disengagement of the projections in the recesses and is not sufficient to exceed the modulus of elasticity of the tie members whereby, upon release of the torsional forces which might cause such movement of parts, the tie members draw the laminates back together, into precise alignment and so that the projections 16 are again fully seated in the recesses 15.

The tie members are preferably engaged in the apertures 14 in such a manner that upon the application of torsional forces between adjacent laminates they tend to limit or impede the relative rotational movement of the laminates and resulting relative movement of the means D as noted above. Further, the limited relative rotational movement of the laminates throughout the longitudinal extent of the structure yieldingly tensions and biases the tie members to impart into them sufficient and necessary stored energy or motive power to effect returning of the laminates to their normal aligned position as soon as the biasing forces are released.

It is significant and important to note that the tie members are not relied upon by themselves to establish and maintain driving engagement with and between the laminates L and the total forces of applied torque are not resolved in shear on the tie members.

It has been determined that if the tie members alone are employed or relied upon to estabish and maintain driving engagement between laminates, the repeated application of torsional forces, particularly impacting torsional forces, results in deformation of the laminates about the opening therein, as well as deforming and hardening of the tie members with resulting loosening and premature failure of the assembly.

With the means D here provided, the extent to which the tie members can work in and relative to the openings or apertures 14 is effectively limited to such an extent that adverse working, wear and fatigue of the tie members and the related operative portions of the laminates related thereto is effectively limited to a negligible extent or is eliminated.

The form Y of laminates L which define or establish the front end portion of the structure in which the socket S occurs are characterized by central polygonal or hexagonal openings S′ which cooperate to define the socket S when the laminates Y are assembled.

The form Z of laminates L which define or establish the rear end of the structure in which the tool receiving opening O occurs are characterized by central polygonal or square openings O′ which cooperate to define the opening O when the laminates Z are assembled.

As noted in the foregoing, and as will be quite obvious, the size and exact configuration of the openings S′ and O′ and resulting size and shape of the sockets S and openings O in the structure can be varied widely in practice and that any changes or variations in the size and shape of said sockets and openings can be easily and economically effected, without departing from the spirit of this invention.

The form X of laminates L which define the central portion of the structure can have imperforate central portions; can have openings similar to the openings S′ or O′; or can, as shown, be provided with a distinctive central opening 20 which cooperates to define a central through opening in the structure to facilitate clearing of the structure and the like, as well as to eliminate excess weight.

In the one preferred carrying out of my invention shown in the drawings, I provide stress relief means R in the structure where the forces applied through the structure by related work and drive tools is directly resolved, that is, at the corners within the structure established by the converging surface of the polygonal work receiving and drive tool receiving socket A and opening O. More particularly, the inside corners on the laminates L defined by openings S′ and O′ are stress relieved. The means R includes radial reliefs 40 and 41 established in the laminates during and as a part of the stamping operation establishing the laminates. The reliefs 40 and 41 are in the form of circular openings at the intersections of adjacent openings R′ and O′ of the laminates and eliminate the sharp stress rise corners that would otherwise be defined by the intersection of adjacent edges of the openings R′ and O′ in the laminates.

While the relief openings 40 and 41 in the laminates L cooperate to define longitudinally extending relief grooves in the socket S and opening O in the completed structure, their principal function is to provide desired stress relief in the inidividual laminates.

It will be apparent that in practice, as in the case of a short socket, the laminates X′ can be elevated. Also, in the event a socket of greater than normal length is required, the central section X can be extended by adding the desired or suitable number of laminates X′.

Figure 7:
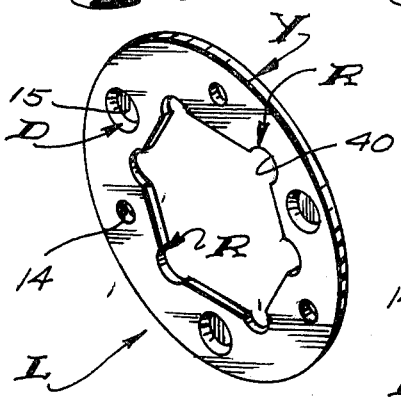
FIGS. 7, 8 and 9 are isometric views of three basic forms of laminates going to make up the structure that I provide.
Figure 8:
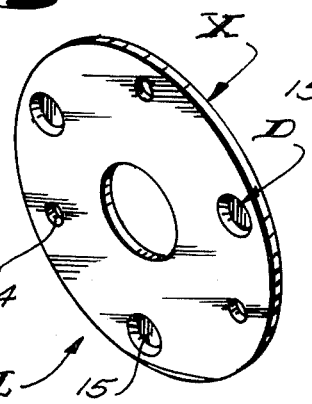
Figure 9:
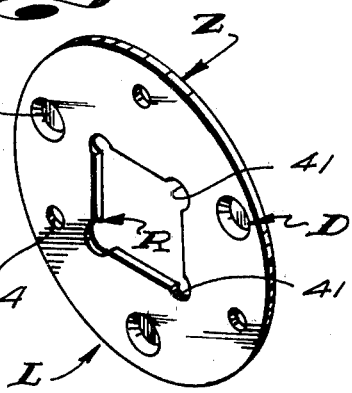
Figure 10:
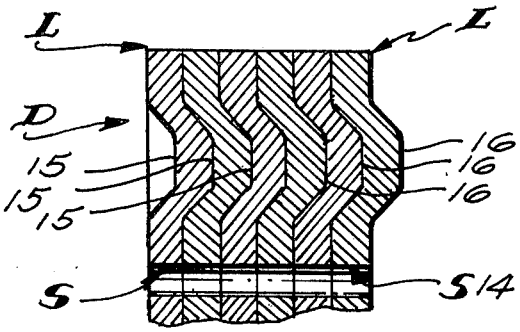
FIG. 10 is an enlarged detailed view of the force transmitting means that I provide.

In practice, when it is desired to provide the socket S and/or opening O with ball detents, such as is indicated by the reference characters 21 and 22, a limited number of selected laminates Y and Z can be formed with recesses in sides of the central openings S′ and O′, as indicated in phantom lines in FIGS. 7 and 8 of the drawings.

Figure 11:
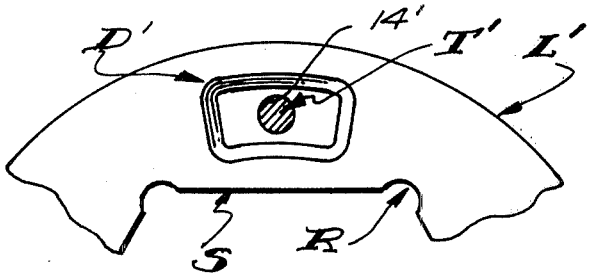
FIG. 11 is a view showing another form of force transmitting means.

In practice, and as shown in FIG. 11 of the drawings, the formed recess and projection portions of the laminates L′ and which establish the means D′ can be elongated and enlarged to a sufficient extent to accommodate the opening 14′ through which the tie members T′ extend.

Figure 12:
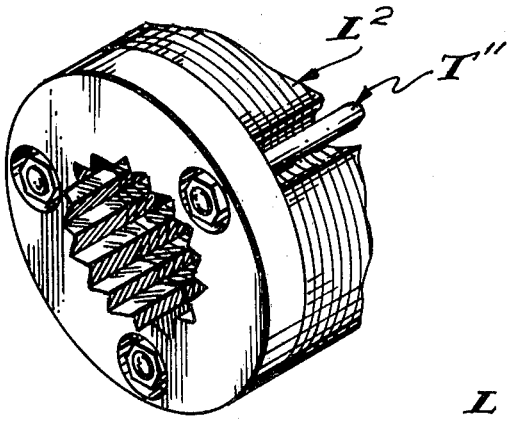
FIG. 12 is an isometric view of one end portion of another form of my invention.
Figure 13:
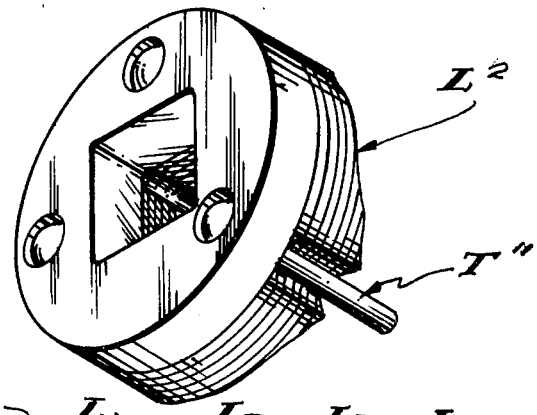
FIG. 13 is an isometric view of the other end portion of the form of invention shown in FIG. 12.

In practice, and as shown in FIGS. 12 and 13 of the drawings, the tie members can be in the nature of nut and bolt assemblies T″ whereby the structure is more readily capable of disassembly. Further, the ends of the structure can be provided with forged end plates with recesses to accommodate the heads of the tie bolts and the nuts. Still further, the openings 14″ for the bolts of the assemblies T″ can be in the form of radially outwardly opening longitudinal grooves establish by similarly disposed notches formed in the laminates $L^2$.

Any one or more of the above noted distinguishing features can be adapted and put to use in the basic structure shown in FIGS. 1 through 10 of the drawings and are illustrative of the nature and/or types of modifications that can be made without departing from the spirit of the invention.

Figure 14:
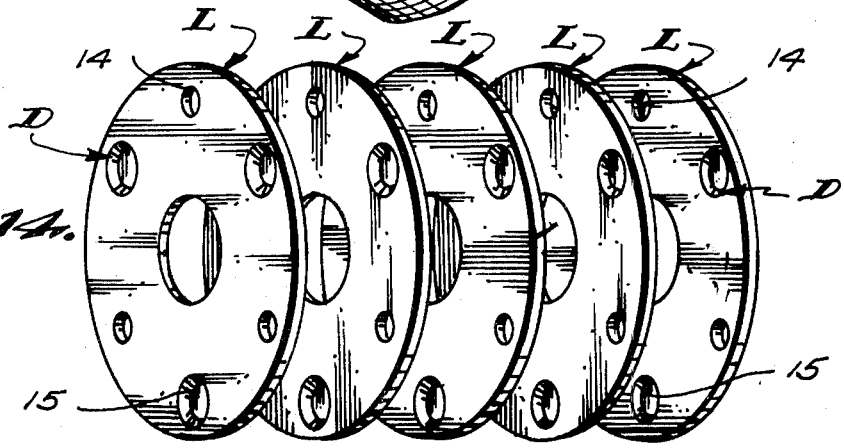
FIG. 14 is a diagrammatic view illustrating a special relationship of the relationship of the grain.

In FIG. 14 of the drawings, I have shown a plurality (5) of laminates and have, by surface shading, illustrated the direction of the metal grain in each. I have also shown the manner in which the direction of grain of each laminate can be advantageously related to the direction of grain of adjacent laminates to obtain a structure wherein the straight of material is most effectively used.

As regards FIG. 14, the surface shading can, in addition to or instead of indicating direction of metal grain, can be viewed as indicating distinct metal, such as aluminum and steel.

Having described but one typical preferred form and carrying out of my invention, I do not wish to be limited to the specific details herein set forth but wish to reserve to myself any modifications or variations which may appear to those skilled in the art and which fall within the scope of the following claims.

Having described my invention, I claim:

1. An elongate drive socket with front and rear end portions defining substantially axially forwardly and rearwardly disposed front and rear ends, said front end portion defining an elongate, central, forwardly opening central work receiving polygonal socket and said rear end portion defining an elongate, central, rearwardly opening drive tool receiving polygonal opening, said drive socket defined by a multiplicity of substantially flat radially extending laminates of sheet metal stock in intimate juxtaposition, said laminates having a plurality of axially aligned registering openings in radial and circumferential spaced relationship about the axis of the drive socket, elongate tie members engaged through said registering openings and having means at their ends in stopped engagement with the front and rear ends of the drive socket, the laminates defining the front and rear portions of the drive socket having central polygonal openings corresponding in configuration with the cross-section of the work receiving polygonal socket and drive tool receiving polygonal opening in their related portions of the drive socket.

2. The drive socket set forth in claim 1 including interengageable drive means defining torsional driving engagement between adjacent laminates, said drive means including axially projecting and axially opening interengaged projections and recesses at the opposing surfaces of adjacent laminates.

3. The drive socket set forth in claim 1 including interengageable drive means defining torsional driving engagement between adjacent laminates, said drive means including a plurality of radially and circumferentially spaced axially projecting and axially opening interengaged projections and recesses in the opposing surfaces of adjacent laminates.

4. The drive socket set forth in claim 1 including a plurality of circumferentially spaced axially opening detents formed in the laminates and define projections projecting axially opposite from the detents, the projections opposing adjacent laminates entering the detents in said adjacent laminates and cooperating therewith to establish torsional driving engagement between said adjacent laminates.

5. The drive socket set forth in claim 4 wherein said detents have axially disposed substantially central bottoms and inclined sides extending substantially axially and radially outward from the central longitudinal axis of the detents, said projections having sides cooperatively engaging and establishing wedging engagement with related sides of related detents.

6. The drive socket set forth in claim 5 wherein said detents and projections are formed in the laminates about said registering openings and about said tie members.

7. The drive socket set forth in claim 6 wherein the corners defined by the intersecting sides of the polygonal openings in the laminates are stress relieved by substantially circular relief openings intersecting said corners whereby said polygonal socket and drive tool receiving opening are characterized by substantial cylindrical, axially extending, stress relief channels between their convergent sides.

8. A drive socket as set forth in claim 1 wherein the laminates are of milled sheet metal stock with a substantially straight linear grain across the plane of the stock, the axis of the grain in some laminates being angularly related to the axis of the grain in other laminates.

9. A drive socket as set forth in claim 8 wherein the axis of the grain in each laminate is angularly related to the axis of the grain in each adjacent laminate.

* * * * *